US007450272B2

(12) United States Patent
Tasaka et al.

(10) Patent No.: US 7,450,272 B2
(45) Date of Patent: Nov. 11, 2008

(54) METHOD AND SYSTEM FOR PRINTING MANAGEMENT

(75) Inventors: Norifumi Tasaka, Hiroshima-ken (JP); Takahide Toshito, Hiroshima-ken (JP); Yasuharu Suda, Hiroshima-ken (JP); Shunichi Hashimoto, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 584 days.

(21) Appl. No.: 11/297,442

(22) Filed: Dec. 9, 2005

(65) Prior Publication Data

US 2006/0238817 A1 Oct. 26, 2006

Related U.S. Application Data

(60) Provisional application No. 60/674,297, filed on Apr. 25, 2005.

(51) Int. Cl.
*B41C 1/04* (2006.01)

(52) U.S. Cl. ..... 358/3.29; 358/1.1; 358/1.9; 358/518; 358/296

(58) Field of Classification Search ..... 358/1.1, 358/1.4, 1.6, 1.9, 3.29, 1.15, 501, 504, 518, 358/523, 468, 296

See application file for complete search history.

(56) References Cited

U.S. PATENT DOCUMENTS

| | | | | |
|---|---|---|---|---|
| 7,349,116 | B2 * | 3/2008 | Wiechers | 358/1.15 |
| 7,349,121 | B2 * | 3/2008 | Dechamps | 358/1.5 |
| 2003/0156299 | A1 * | 8/2003 | Martinez et al. | 358/1.9 |
| 2008/0018918 | A1 * | 1/2008 | Ozaki et al. | 358/1.9 |

FOREIGN PATENT DOCUMENTS

| | | |
|---|---|---|
| JP | 63102936 | 5/1988 |
| JP | 2001171071 | 6/2001 |
| JP | 2001-301124 | 10/2001 |
| JP | 2001341447 | 12/2001 |

* cited by examiner

*Primary Examiner*—Thomas D Lee
(74) *Attorney, Agent, or Firm*—Manabu Kanesaka

(57) ABSTRACT

A method and a system for printing management, with the intension of appropriate color management performed in a newspaper print site in which a number of newspaper rotary presses of two or more types are provided, obtain image data representing each page edited in multilevel image data along with associated data concerning the page and makes a printing plate based on the image data and concurrently select a newspaper rotary press and a print material used for printing the page based on the multilevel image data and the associated data; perform color correction of the multilevel image data in accordance with the types of the selected rotary press and print material based on the color management data previously prepared, which multilevel image data is to be converted into binary image data and used for making a printing plate.

22 Claims, 10 Drawing Sheets

METHOD AND SYSTEM FOR PRINTING MANAGEMENT

BACKGROUND OF THE INVENTION

1. Field of the Invention

The present invention relates to a method and a system for printing management preferably applied to printing of national newspapers that are circulated nation-wide at local newspaper print sites.

2. Description of the Related Art

For example, in general practice, a general newspaper company with national circulation collectively prepares and edits newspaper pages at the head office and prints the newspaper pages at locally disposed newspaper print sites with the intention of delivery of the latest possible information to readers. In such a print system, each newspaper print site receives the edited print data by means of communication with the head office and makes printing plates for printing.

For example, accompanying drawing FIG. 9 shows the configuration of an example of a newspaper print system currently in use. As shown in FIG. 9, on the head office side, an editorial center (in which editorial operations are practically performed on multimedia data including not only newspapers but also other media) prepares and edits a newspaper.

The result of newspaper editing is given in the form of multilevel image data, but the head office generally sends each newspaper print site print data in the form of binary image data obtained by previously performing RIP (Raster-Image Processing) on the multilevel image data. By way of example, the head office sends each newspaper print site binary image data (page image data in dot data or bitmap data) concerning each individual color of CMYB (Cyan, Magenta, Yellow, Black) if the newspaper page is to be printed in color.

Upon receipt of print data (binary image data) from the head office, each newspaper print site inputs page indexes (codes or other information concerning plate name, page, color) corresponding to binary image data (page image data) representing each of the newspaper pages and a printing press that is to be used for printing the page with binary image data in a site management system. Meanwhile, a registration mark and a cutoff mark are put to the binary image data (page image data) representing each newspaper page. Such a registration mark and a cutoff mark are put to positions predetermined for the space respectively.

In succession, a printing plate is made on the basis of the binary image data having sustained the above processes by, for example, using an apparatus of CTP (Computer-To-Plate) or CTF (Computer-To-Film). A CTF apparatus generates a film with a page image but a CTP apparatus generates a printing plate. A CTF apparatus therefore makes a printing plate, using the generated film. A printing plate made by either manner is usually mounted, by hand, on a newspaper rotary press that is to print the image.

After that, each newspaper page is printed by the corresponding newspaper rotary press. During the print operation, a rotary press controlling system automatically controls the newspaper rotary press, and an automated registration unit and a cutoff controller respectively adjust registration and cutoff with reference to the registration mark and the cutoff mark that have been previously put (placed).

It should be note that newspaper printing has to provide the readers with the latest information in a highly accurate manner. Specifically, newspapers are required to provide their readers with faithful reproductions of image data without, of course, typographic errors. Especially, modern color newspapers have various problems in faithfully reproducing color image data by a print operation.

In other words, a normal color printing press such as a planographic offset printing press requires faithful reproduction of the color tone in addition to accurate registration concerning each color of CMYB (Cyan, Magenta, Yellow, Black). Such demands have arisen in recent newspaper color printing.

As a solution, a Japanese Patent Application Laid-Open (KOKAI) Publication No. 2001-301124 proposes an application of a color management technique frequently used for color printers which obtain color outputs by using color monitors that display image data on computers to a normal printing press exemplified by a planographic offset printing press.

The color management technique has been invented in order to solve the problem that color printers that output color images using image data and color monitors that display image data on computers do not obtain the same color reproducibility even if the same image data is used. Specifically, the technique prepares a device profile (hereinafter, simply called a profile) which describes a color reproducibility for each input or output device that uses digital data, and converts colors in digital image data on the basis of the profile through the intermediate of device-independent colors depend on any devices. An industrial standard of such a profile is represented by the ICC profile that has been standardized by an international standardization organization of the International Color Consortium (ICC).

A general printing press such as planographic offset printing press separates the plate making step from the printing step, and has made most printing plates by analog light exposure. Color management has therefore not been carried out in such printing presses. In accordance with practical use of the above-mentioned CTP technique (i.e., a plate making technique that forms an image on the surface of a printing plate on the basis of digital image data), color management using profile data proposed in the above patent application would have been able to be applied to an ordinary printing press exemplified by an offset printing press.

For example, the above patent application may carry out color management on image data to be used for making a printing plate, to which ink is applied so that the image is printed.

More specifically, first of all, multilevel image data representing an image to be printed sustains a RIP to be converted into binary image data, which is subsequently used for recording an image including a multilevel color chart on a printing plate (for making a printing plate). At least one of an ink or a web that are to be used for printing the image is determined, and the printing press prints the image, using the determined ink and/or web and the printing plate made in the previous step. Then each of the colors printed on the color chart is measured and on the basis of the measurement result, a profile data representing a printing characteristic of the printing press when the determined ink and/or web are used is generated. The obtained profile data is stored with the profile data being correlated with the determined ink and/or web. After that, when the printing press prints an image using the determined ink and/or web, color correction is performed on the image data based on the obtained profile data before the RIP step. The above procedure enables an ordinary printing press to perform color management depending on the profile.

Such a color management technique would be applicable to newspaper printing in which color printing has been increasing in recent years.

It should be also be mentioned that a newspaper print site usually includes a number of newspaper printing presses that may be of the same or different types. The number of pages of a newspaper to be printed and the page contents (e.g., color page or monochrome page) of each of the newspaper pages determine newspaper rotary presses, one for each page.

In particular, a single newspaper rotary press is equipped with as many as about 20 plate cylinders, which may be different in inking method and/or dampening method. The running condition determines which plate cylinder prints which newspaper page, and is frequently different each time the rotary press is run: a feature peculiar to newspaper printing.

Besides, print materials (ink, web) used for newspaper pages may be changed in accordance with a type of a newspaper rotary press and with the contents of a page image.

For this reason, application of the above color management to newspaper printing performed in a newspaper print site may result in wrong color correction unless the above feature peculiar to newspaper printing is not considered. In other words, mere retaining of the profile data with the data correlating with types of ink and/or web cannot suitably carry out color management on newspaper rotary presses different in type and on each individual newspaper rotary press.

Further, partly since color management is performed on multilevel image data and partly since the above conventional system sends each newspaper print site locally disposed binary image data representing the prepared and edited page images so that the newspaper print site obtains only the binary image data, the newspaper print site cannot perform color management in accordance with individual newspaper rotary presses in the newspaper print site.

Printing management may sometimes require accurate registration, fanout consideration, and/or accurate cutoff. For example, if a column stretching from a registration mark put (placed) on a fixed predetermined position of a space (i.e., the same position as the registration mark in the direction of the print-roll width) is not printed in color, insufficient ink is applied, so that an unclear registration mark is printed and may be a cause of misrecognition of the registration mark. Especially, a registration mark portion in yellow, i.e., a color close to that of the background, tends to be misrecognized. Further if a cutoff mark is put on a predetermined fixed position and a pattern resembling the cutoff mark is formed on a position the same in the left-to-right direction (the web-width direction) but different in the top-to-bottom direction in relation to the cutoff-mark position, there is a possibility that the pattern will be misrecognized as a cutoff mark.

SUMMARY OF THE INVENTION

With the foregoing problems in view, it is an object of the present invention to provide a method and a system for printing management performed in a newspaper print site for the purpose of appropriate color management.

To attain the above object, as a first generic feature, there is provided a method for printing management carried out in a newspaper print site in which a number of rotary presses of two or more types for newspaper are provided, the method obtaining image data representing an image of each page that has been edited in the form of multilevel image data along with associated data concerning the page, making a printing plate for the page based on the image data and causing one of the rotary presses to print the image of the page using the printing plate, and comprising the steps of: (a) obtaining the multilevel image data and the associated data, and recording the multilevel image data and associated data as print data in a memory; (b) selecting, on the basis of the multilevel image data and the associated data obtained in the step (a) of obtaining, at least one of the rotary presses that is to print the image of the page and a print material that is to be used for print of the image, and retaining schedule data including the one rotary press selected and the print material selected as the print data in the memory; (c) performing color correction for color reproducibility on the multilevel image data obtained in the step (a) of obtaining in accordance with a type of the one rotary press and a type of the print material selected in the step (b) of selecting based on color management data that has previously been prepared in consideration of a combination of the type of the one rotary press and the type of the print material selected in the step (b) of selecting; (d) performing RIP (Raster-Image Processing) on the multilevel image data, on which the color correction has been performed in the step (c) of performing color correction, so that the multilevel image data is converted into binary image data; (e) forming the image of the page on a plate, using the binary image data obtained in the step (d) of performing RIP, so that the printing plate is made ready for printing; and at the one rotary press selected in the step (b) of selecting; (f) printing the image of the page on a web, using the printing plate made ready for printing in the step (e) of forming and the print material selected in the step (b) of selecting.

The above multilevel image data includes binary image data which can be converted into multilevel data with respect to a printing resolution level and which is much higher in resolution than the printing resolution level.

The above associated data is exemplified by plate name data, page data, and/or color data, and the above print material is exemplified by ink and/or web.

As a preferable feature, the method may further comprise the step, serving as preparation for the step of performing color correction, of preparing the color management data being performed prior to the step (c) of performing color correction and comprising the sub-steps of: (i) measuring printing colors on color charts printed one by each of possible combinations of one of the rotary presses and a print material; (ii) preparing profile data representing a print characteristic of each of the possible combinations on the basis of a result of the step (i) of measuring; and (iii) retaining the profile data and correlation of the profile data with a type of the one rotary press and a type of the print material of each of the possible combinations for preparing the color management data.

As another preferable feature, the method may further comprise the steps of: prior to the step (c) of performing color correction, retrieving a position on which all the printing colors are to be surely printed in the image of the page from the multilevel image data, and putting a registration mark in accordance with the position retrieved in the step of retrieving, and, in the step (f) of printing, registration may be carried out by feedback control, recognizing the registration mark put in the step of putting.

As an additional preferable feature in this case, registration mark recognition means for recognizing the registration mark may be adjustably disposed on the one rotary press, and a position of the registration mark recognition means may be automatically adjusted in accordance with position data of the registration mark.

As a further preferable feature, the method may further comprise the steps of: prior to the step (c) of performing color correction, retrieving a position on which a pattern resembling a cutoff mark does not appear from the multilevel image data, and putting the cutoff mark in accordance with the position retrieved in the step of retrieving; and after the step (f) of printing, cutting the web on which the image has been printed in the step (f) of printing into sheets each having a predetermined length, and, in the step of cutting, positions at which the web is cut into the sheets maybe adjusted by feedback control, recognizing the cutoff mark put in the step of putting.

As a still further preferable feature, the method may further comprise the steps of: prior to the step (c) of performing color correction, assigning a particular pattern that resembles a cutoff mark and that is not confused with another pattern as a substitutive cutoff mark ; and after the step (f) of printing, cutting the web on which the image has been printed in the step (f) of printing into sheets each having a predetermined length, and, in the step of cutting, positions at which the web is cut into the sheets may be adjusted by feedback control, recognizing the substitutive cutoff mark assigned in the step of assigning.

As a still another preferable feature in these cases, cutoff mark recognition means for recognizing the cutoff mark put in the step of putting or the substitutive cutoff mark assigned in the step of assigning may be disposed on the one rotary press, and a position of the cutoff mark recognition means may be automatically adjusted in accordance with position data of the cutoff mark or the substitutive cutoff mark.

As a still further preferable feature, the method may further comprise the step of performing fanout inhibition correction on the binary image data obtained in the step (d) of performing RIP in order to inhibit possible fanout that is to be caused on the web.

As a still further preferable feature, the method may further comprise the steps of: at an editorial site different in location from the printing site, preparing the multilevel image data representing the image of the page; sending the multilevel image data prepared in the step preparing and the associated data concerning the multilevel image data to the newspaper print site from the editorial site through communication means.

As a second generic feature, there is provided a system for printing management carried out in a newspaper print site in which a number of rotary presses of two or more types for newspaper are provided comprising: a database for retaining color management data that has previously been prepared in consideration of possible combinations of a type of each of the rotary presses and a type of each print material each of the combinations being used for printing; a print data storing apparatus for storing image data representing an image of a page that has been edited in the form of multilevel image data, associated data concerning the page, a type of at least one of the rotary presses that is to print the image of the page and a type of a print material that is to be used for printing the image along with a correlation among the multilevel image data, the associated data, the type of the one rotary press and the type of the print material; a color management apparatus for obtaining a portion of the color management data from the database which portion concerns the type of the one rotary press and the type of the print material that are to be used to print the image of the page and performing correction for color reproducibility on the multilevel image data, depending on the type of the one rotary press and the type of the print material, on the basis of the portion of the color management data; a RIP (Raster-Image Processing) unit for performing RIP on the multilevel image data, on which the correction has been performed by the color management apparatus, into binary image data; a printing plate making unit for recording the image of the page, using the binary image data, into which the multilevel image data has been converted by the RIP unit, on a printing plate, so that the printing plate is made ready for printing; the one rotary press for printing the image of the page on a web in a state that the printing plate, which is made ready for printing by the printing plate making unit, is mounted on the one rotary press using the print material on the basis of the correlation stored in the print data storing apparatus.

As a preferable feature, the system may further comprise an imaging unit for measuring colors printed on color charts, one printed by each of the possible combinations; and a profile data preparing unit for preparing profile data representing a print characteristic for each possible combination on the basis of the measuring of the colors by the imaging unit, the database being prepared by correlating the profile data and each possible combination.

As another preferable feature, the system may further comprise a registration mark putting section for retrieving a position on which all the print colors are to be surely printed in the image of the page from the multilevel image data and putting a registration mark in accordance with the position retrieved, and the one rotary press may carryout registration by feedback control, recognizing the registration mark, which has been put by the registration mark putting section.

As an additional preferable feature in this case, the system may further comprise a registration mark recognition section, adjustably disposed, for recognizing the registration mark, and a position of the registration mark recognition section may be automatically adjusted in accordance with position data of the registration mark, which has been put by the registration mark putting section.

As a further preferable feature, the system may further comprise a cutoff unit, mounted on the one rotary press, for cutting the web on which the image has been printed by the one rotary press into sheets each having a predetermined length; and a cutoff mark putting section for retrieving a position on which a pattern resembling a cutoff mark does not appear from the multilevel image data and putting the cutoff mark in accordance with the position retrieved, and the cutoff unit may adjust a position at which the web is cut into the sheet by feedback control, recognizing the cutoff mark, which has been put by the cutoff mark putting section.

As a still further preferable feature, the system may further comprise a cutoff unit, mounted on the one rotary press, for cutting the web on which the image has been printed by the one rotary press into sheets each having a predetermined length; and a cutoff mark assigning section for assigning a particular pattern that resembles a cutoff mark and that is not confused with another pattern as a substitutive cutoff mark, and the cutoff unit may adjust positions at which the web is cut into the sheets by feedback control, recognizing the substitutive cutoff mark, which has been assigned by the cutoff mark assigning section.

As a still further preferable feature in these cases, the system may further comprises a cutoff mark recognizing section, adjustably disposed, for recognizing the cutoff mark, which has been put by the cutoff mark putting section, or the substitutive cutoff mark, which has been assigned by the cutoff mark assigning section, and a position of the cutoff mark recognizing section may be automatically adjusted in accordance with position data of the cutoff mark or position data of the substitutive cutoff mark.

As a still further preferable feature, the system may further comprise a fanout correction unit for performing fanout inhibition correction on the binary image data obtained by the RIP unit.

As a still further preferable feature, the system may further comprise an editorial system, disposed at an editorial site different in location from the newspaper print site, for preparing the multilevel image data representing the image of the page; and a communication unit for sending the multilevel image data prepared in the editorial site and the associated data concerning the multilevel image data prepared to the newspaper print site from the editorial site.

As a still further preferable feature, the printing plate making unit may be an on-board printing plate making unit for making the printing plate on the basis of the print data stored in the print data storing apparatus with the printing plate being mounted on the one printing press.

As a still another preferable feature in this case, the on-board printing plate making unit may adopt the ink-jet method.

Since the method and system for printing management of the present invention determine a print schedule and manage printing operation sharing the print schedule shared, it is possible to realize suitable color management in each newspaper print site in which a number of newspaper printing presses of two or more types are provided so that a page printed in color is reproduced in a desired color tone with high accuracy. Consequently, printing quality can be improved.

Especially, in a case where the editorial center (e.g., the head office of the newspaper company) prepares each page of a newspaper and sends data of the page to local newspaper print sites, which print the newspaper, if the sent data concerning the page is multilevel image data, the above color management can be performed on the multilevel image data with ease.

Since a position on which all the printing colors are to be surely printed is retrieved from the multilevel image data and a registration mark is put in accordance with the retrieved position, it is possible to definitely recognize the registration mark to thereby avoid color shift.

Accurate registration can be realized with ease by automatic adjustment of the position of the registration mark recognition means on the basis of the position data of the registration mark.

Further, a position on which a pattern resembling the cutoff mark does not appear is retrieved and the cutoff mark is put in accordance with the position retrieved, with the result that it is possible to surely recognize the cutoff mark and to accurately cut the web into the sheets.

Also in this case, accurate cutoff can be realized with ease by automatically adjusting the position of the cutoff mark recognition means on the basis of the position data of the cutoff mark.

Further, application of the fanout inhabitation correction to the binary image data having sustained a RIP improves printing quality.

Still further, if the plate making unit is an on-board printing plate making unit which makes a printing plate with the plate being mounted on a newspaper printing press on the basis of information stored in the printing data storing apparatus, it is possible to further save energy consumption and eliminate human error.

Still further, adoption of an ink-jet method to the on-board printing plate making unit makes printing management for each newspaper print site easier. More specifically, outputting ink onto a hydrophilic surface of the printing plate from the ink-jet head in accordance with the binary image data forms an oleophilic image area and that substantially eliminates registration shift. As a result, it is possible to more appropriately perform printing management for a newspaper print site. Especially, because of outputing ink onto the surface of a hydrophilic surface of the printing plate from the ink-jet head in accordance with the binary image data forms an oleophilic image area, the ink-jet method makes a printing plate without a development step (so-called processless), and can therefore make the step of making a printing plate simple. Rapid printing management can be carried out for a newspaper print site.

Other objects and further features of the present invention will be apparent from the following detailed description when read in conjunction with the accompanying drawings.

DESCRIPTION OF THE PREFERRED EMBODIMENTS

FIGS. 1-7, 8(*a*), 8(*b*) and 10 concern a method and a system for printing management for a newspaper print site according to an embodiment of the present invention. A preferred embodiment of the present invention will now be described with reference to the accompanying drawings.

Figure 1:
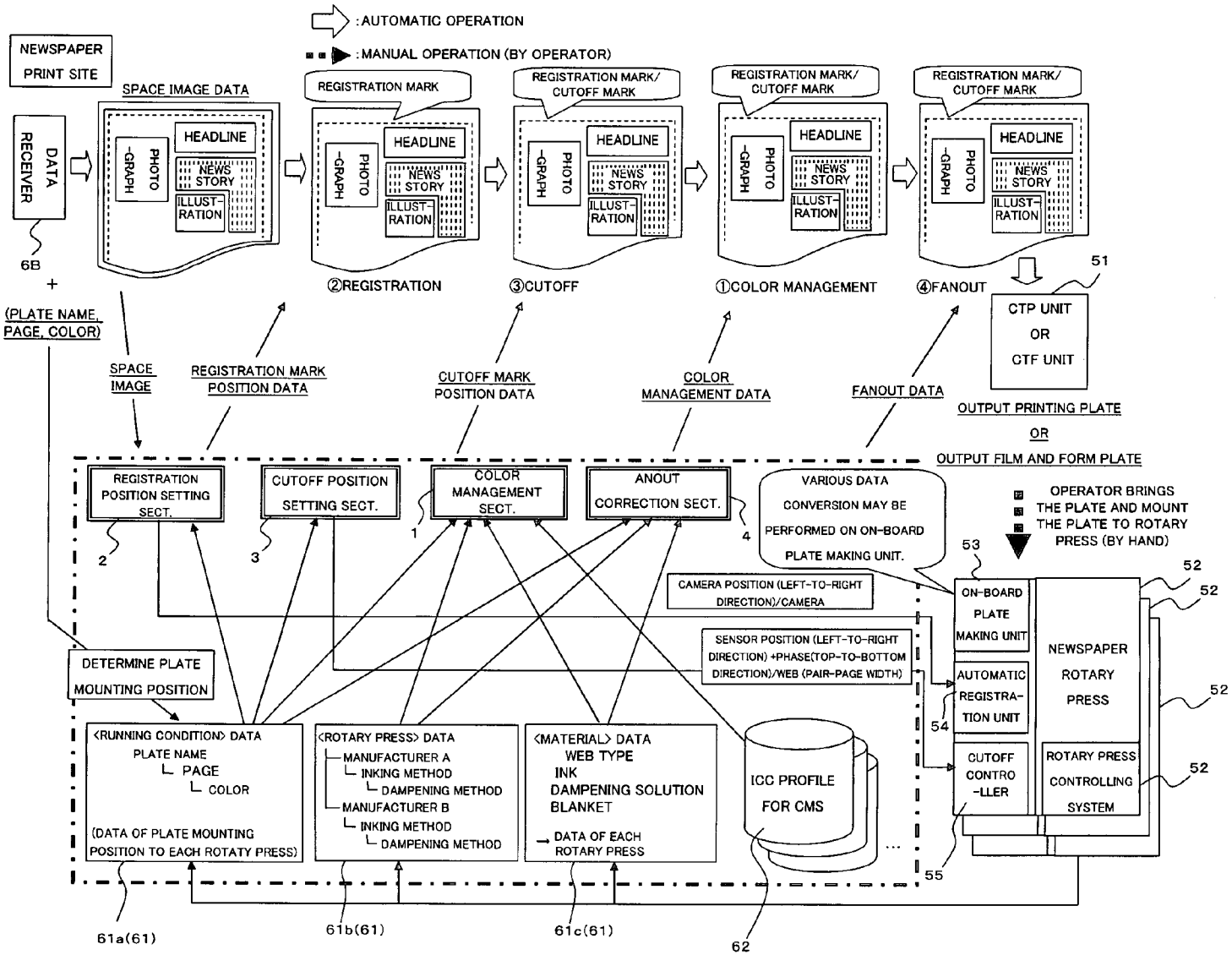
FIG. 1 is a block diagram schematically showing a printing management method and a printing management system for a newspaper print site according to an embodiment of the present invention.
Figure 2:
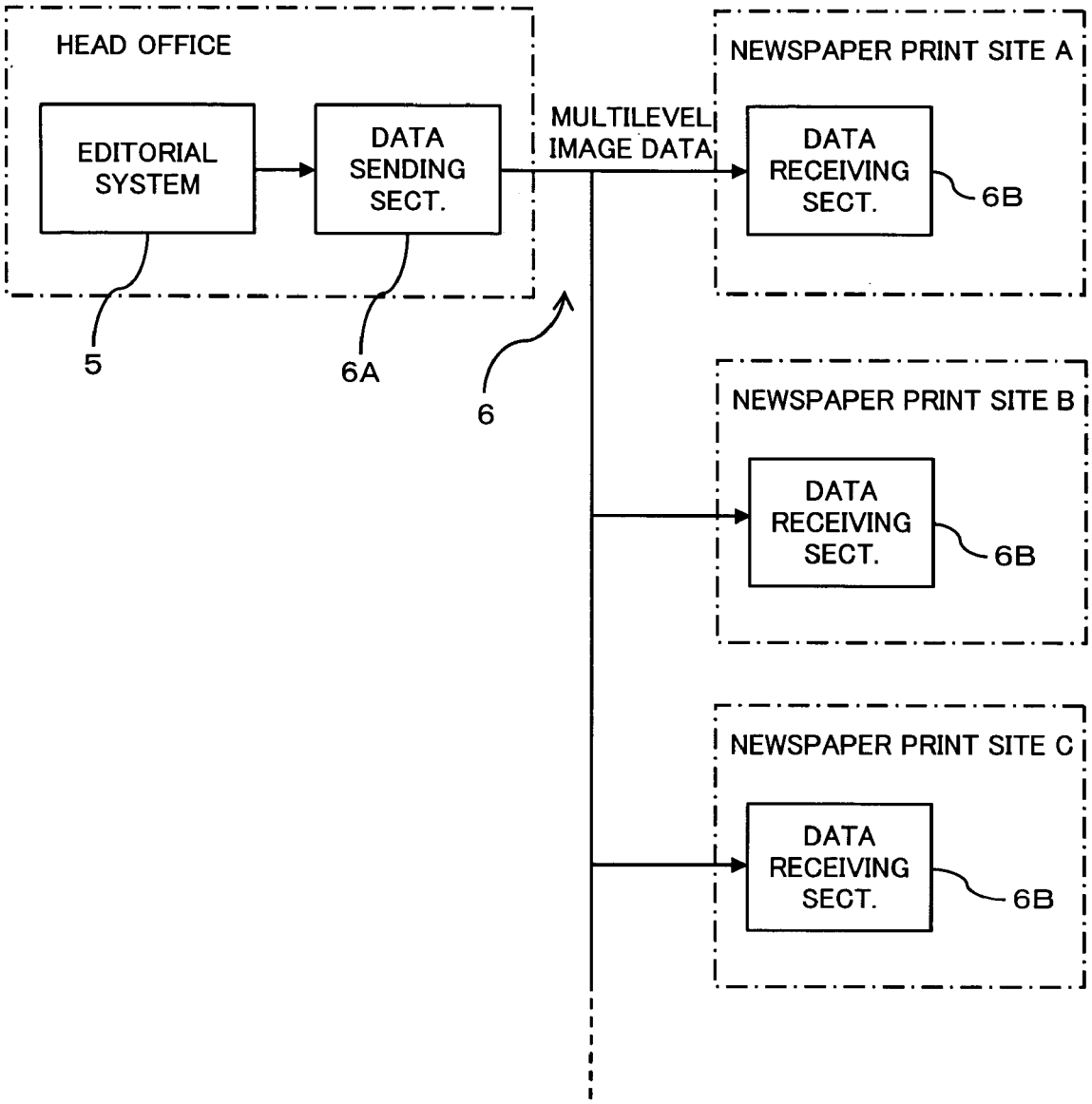
FIG. 2 is a block diagram showing a relationship between each newspaper print site and the head office (an editorial site different in location from the newspaper printing site) in the method and the system for printing management of the embodiment.

As shown in FIG. 2, in an editorial center (in which editorial operations are performed on multimedia data including not only newspaper but also other media) different in location (usually, at the newspaper head office) from the printing site, an editorial system 5 prepares and edits a newspaper. Multilevel image data obtained as a result of the newspaper editorial operation is sent to each of the local print sites by a communication unit 6 that includes a data sending section 6A disposed in the editorial system 5 and a data receiving section 6B disposed at each local print site.

Image data that is to be sent to each print site can be of any type that is able to be handled as multilevel image data. Concerning print resolution level, the multilevel image data includes binary image data that is higher in resolution than a print resolution level that is able to be converted into multilevel data. When each newspaper print site receives such binary image data high in resolution, the high-resolution multilevel image data is temporarily converted into multilevel image data in order to sustain the following process.

At each newspaper print site, the data receiving section 6B receives page image data, in the form of multilevel image data, representing each page of a newspaper, and a registration mark putting section (a registration position setting section) 2 puts a registration mark on each page image represented by the received page image data and then a cutoff mark putting section (a cutoff position setting section) 3 puts a cutoff mark on the page image. Subsequently, a color management system (CMS) 1 carries out a color management process (color correction) on the page image data; a RIP (Raster-Image-Processing) section 12 performs RIP on the multilevel image data to convert the multilevel image data into binary image data; and a fanout correcting section 4 carries out fanout correction on the binary image data.

The binary image data, which represents each page image and which is obtained by the above steps, is formed by binary image data (page image data in dot data or bitmap data) concerning each individual color of CMYK (Cyan, Magenta, Yellow and Black) if the page is in color. The binary data is sent to a printing plate making unit 51, where a printing plate for each page is made. After that, each printing plate is mounted on a newspaper rotary press, which is to print the corresponding newspaper page.

Further, each print site receives associated data with each page of a newspaper along with the multilevel image data which associated data includes running condition data 61*a* of "plate name", "page number", "ink colors to be used for printing" and other data concerning the newspaper page.

The running condition data 61*a* is stored in a print data recording unit 61, which further retains data (rotary press data) 61*b* concerning each rotary press placed in the newspaper print site and data (material data) 61*c* concerning materials (types of web, ink, dampening solution, blanket and other factors) available for printing. The rotary press data 61*b* represents the manufacturer, the type, the adopted inking method, the dampening method and the like of each rotary press.

At the preparing stage for printing, at least one of the printing presses (the rotary presses) placed in the newspaper print site is allocated to printing operation for each page on the basis of running condition data 61*a* and print materials (web, ink, dampening solution, blanket and other factors) that are to be used by the printing press are determined. This allocation and determination may be made by an operator; alternatively, the rotary press allocation may be automatically made based on the running condition data 61*a* and the rotary press data 61*b* stored in the print data recording unit 61 and the material determination may be automatically made based on the rotary press data 61*b* and material data 61*c*.

Here, putting (placing) of a registration mark and a cutoff mark, color management and fanout correction will now be detailed.

Figure 3A:
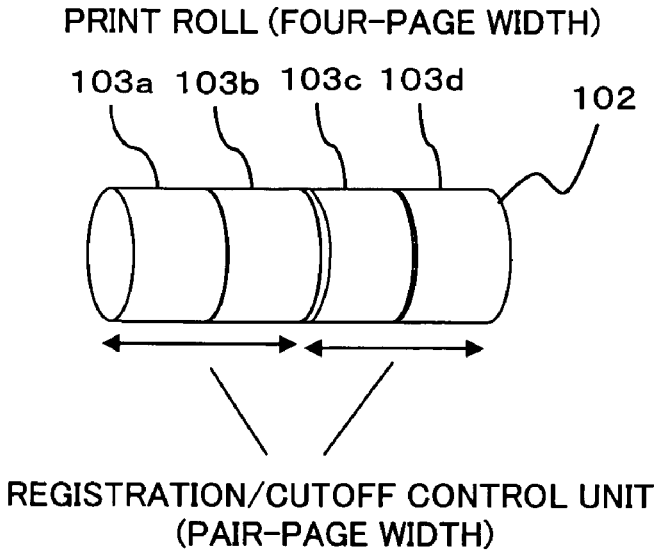
FIGS. 3(*a*) and 3(*b*) are diagrams respectively illustrating a printing roll and a web according to the embodiment, and more particularly, FIG. 3(*a*) is a perspective view schematically illustrating a printing roll to which a printing plate is mounted and FIG. 3(*b*) is a front view schematically illustrating a state in which pair-page images are printed on webs.
Figure 3B:
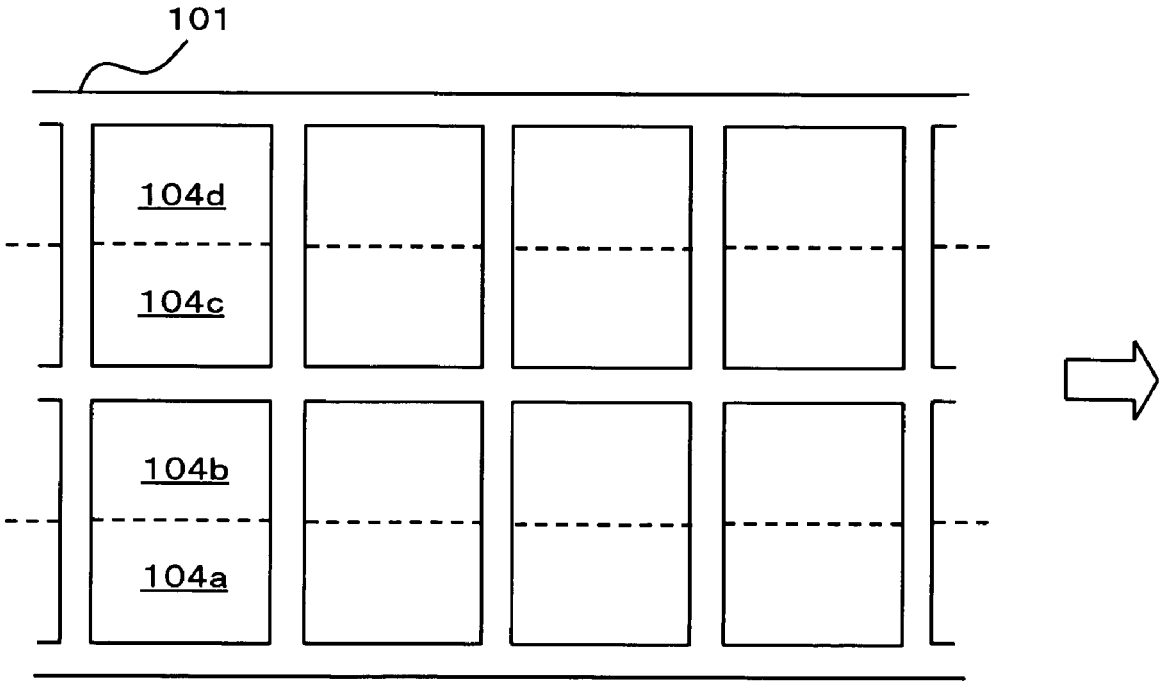

As shown in FIG. 3(*a*), printing plates 103*a*, 103*b*, 103*c*, 103*d* for a number of pages (in this example, a total of four pages of two double-pages arranged in left-to-right direction) are mounted on a printing roll (plate cylinder) 102, to which printing plates are to be mounted. As shown in FIG. 3(*b*), four pages 104*a*, 104*b*, 104*c*, 104*d* are printed on a web 101. Here, double-pages are regarded as one unit and control for registration and cutoff are performed on each unit.

Figure 4A:
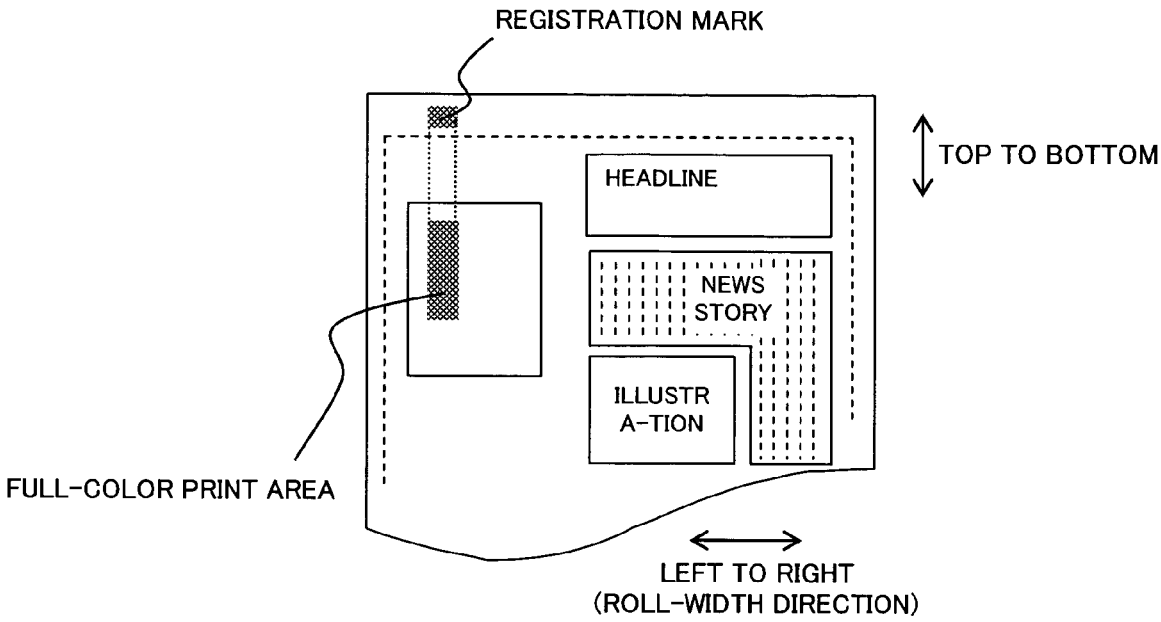
FIGS. 4(*a*) and 4(*b*) are diagrams schematically illustrating a page on which marks are to be put, and more particularly FIG. 4 (*a*) concerns a registration mark and FIG. 4(*b*) concerns a cutoff mark.
Figure 4B:
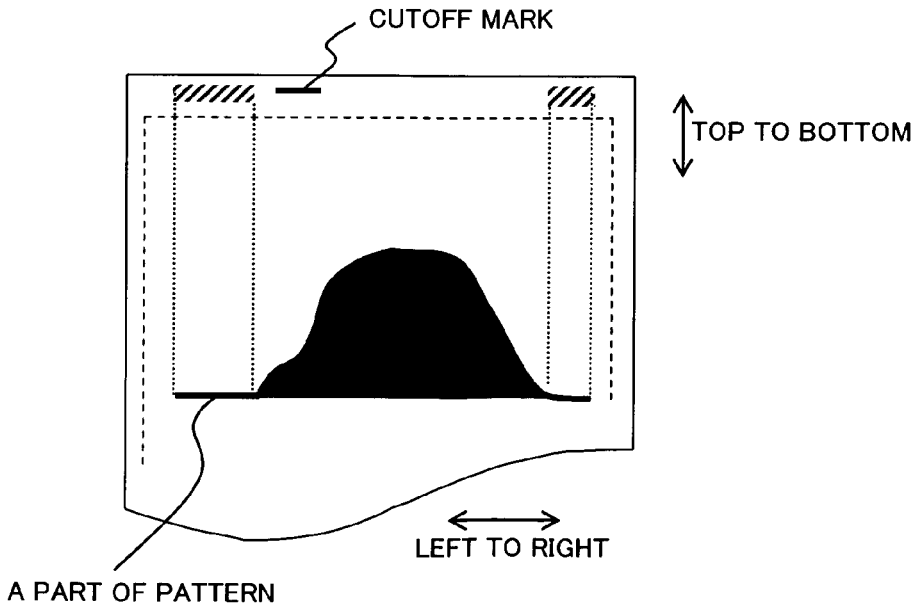

As shown in FIG. 4(*a*), the registration position setting section 2 retrieves a full-color portion (the lower hatched portion in FIG. 4(*a*)) of each page from the multilevel image data concerning the image of the page, sets a position on a column (on a margin on the same in left-to-right position as that of the retrieved full color portion) extending to the retrieved full-color portion (on which all the color used for the page appears) as a position for a registration mark, and puts the registration mark on a position in the multilevel image data corresponding to the determined position.

In other words, ink is supplied to the printing roll 102 in the roll-width direction and, to a portion (in the roll-width direction) on which a certain color is not printed, only a requisite minimum amount of ink concerning the color is applied to a part of the printing roll 102 which part is corresponding to the portion. For this reason, if a registration mark position is determined with disregard of the above point and a color does not appear on a column corresponding to the position, the registration mark is not clearly printed.

As a solution, retrieval is performed in order to find a portion on which all the colors used for a page appear and a position which is the same in the roll-width portion as the retrieved full-color portion and which is on a margin is determined as a register mark position. Thereby it is possible to print a clear registration mark.

A full-color portion, on which all the color for a page is printed, can be retrieved from the above page image data, and previously setting a top-to-bottom position of a registration mark automatically determines the register mark position, requiring no operation by an operator.

Letters may appear on some portions of the margins of each page and a register mark cannot therefore be put on such portions. By way of example, the top margin of the page and the bottom margin may be set as the primary and the secondary suggestion for a registration mark position, respectively, so that it is possible to definitely put a registration mark.

A registration mark can be put simply by superimposition of image data of the registration mark on corresponding page image data, and putting of the registration mark is also automatically put without operation by an operator.

As shown in FIG. 4(*b*), the cutoff position putting section 3 retrieves a pattern (a hatching portion in FIG. 4(*b*)) which resembles a cutoff mark from multilevel image data concerning an image of each page and which is to be printed on a space, excludes a position on a column (on a margin on the same in left-to-right position as that of the pattern portion) extending to the retrieved resembling portion from a position for a cutoff mark, and determines the remaining portion as a cutoff mark putting position.

In other words, a normal cutoff portion takes a form of a straight line segment extends in the width direction of the web having a predetermined width length, and a pattern resembling such a cutoff mark in a page image to be printed may be misrecognized as a cutoff mark. This problem may be solved if a portion on a same column as a pattern resembling the cutoff mark is excluded from suggestion for a cutoff mark putting position and the remaining position is determined as the cutoff mark putting position.

Also a pattern resembling a cutoff mark can be retrieved from the above page image data, and previously setting a top-to-bottom position of a cutoff mark automatically determines the cutoff mark putting position, requiring no operation by an operator.

Also in this case, letters may appear on some portion of the margins of each space and a cutoff mark cannot therefore be put on the portion. For example, the top margin of the space and the bottom margin may be set as the primary and the secondary suggestion for a cutoff mark putting position, respectively, whereupon it is possible to definitely put a cutoff mark.

A cutoff mark can also be put simply by superimposition of image data concerning the cutoff mark on page image data, and putting of the cutoff mark is automatic and does not require operation by an operator.

The color management system 1 obtains color management data corresponding to the printing press type and the printing material types that are to be used for printing, which types are stored in the print data recording unit 61, from a database 62, and carries out color correction on multilevel image data representing the image of each page in accordance with the printing press type and the material types based on the color management data in order to maintain color reproducibility.

Figure 6:
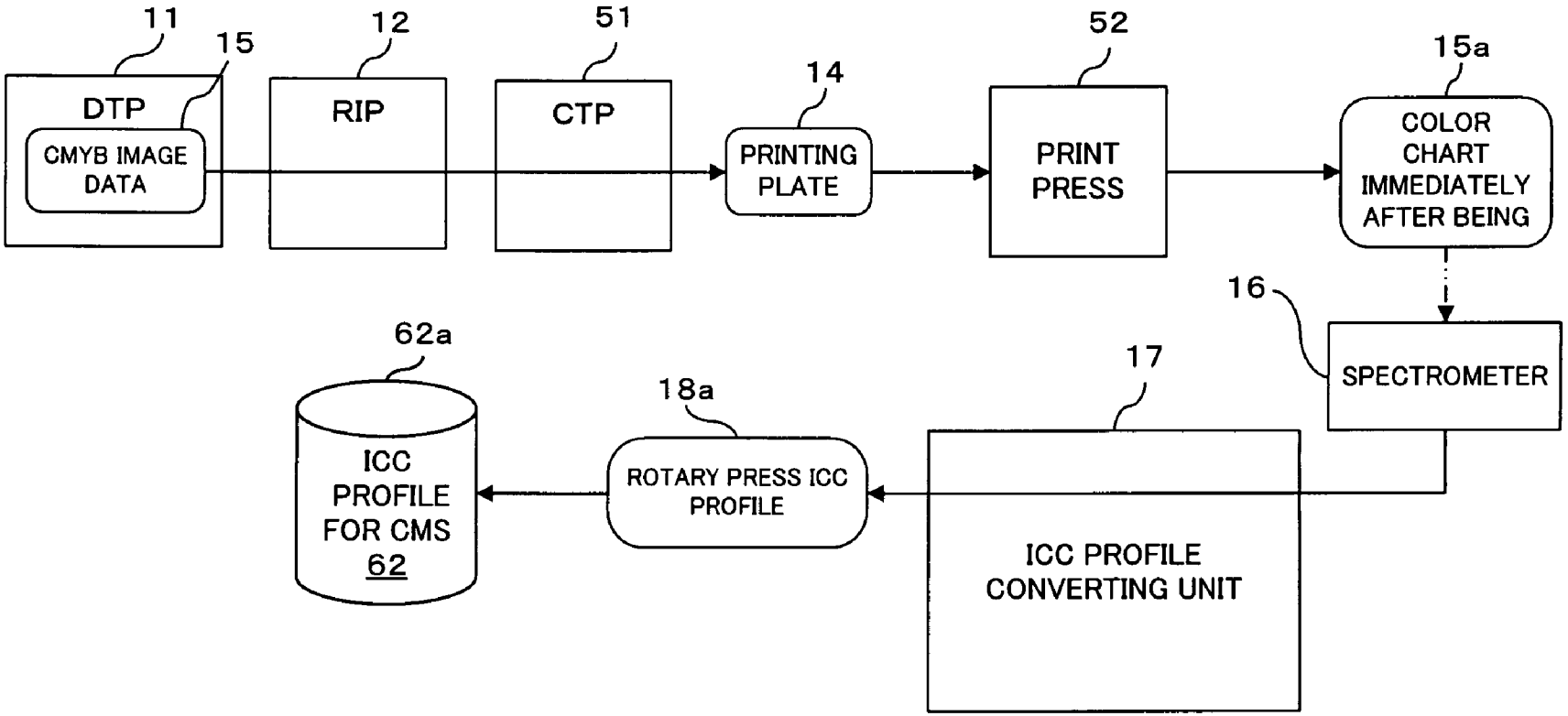
FIG. 6 is a block diagram schematically showing the configuration of a print system according to the embodiment, focusing on a succession of procedural steps performed as ICC profile preparation.
Figure 7:
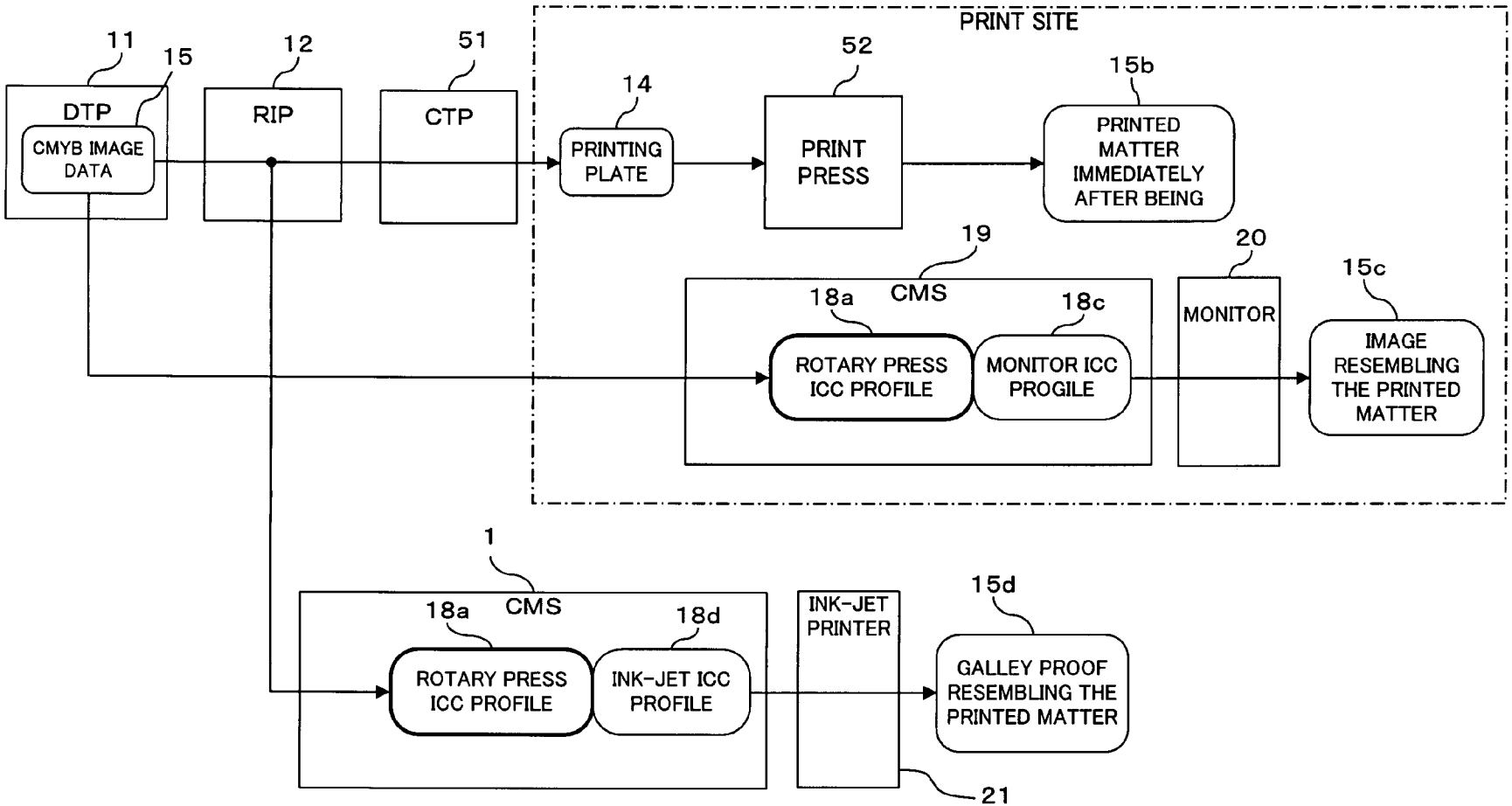
FIG. 7 is a block diagram schematically showing the print system of the embodiment, focusing on a succession of procedural steps performed during a color matching operation.

Color management data is prepared by a system exemplified by FIGS. 6 and 7. The system includes a DTP (Desktop Publishing) unit 11, a RIP unit 12, a CTP (Computer To Plate) unit 51, a printing press 52, a CMS (Color Management System) 1A, a monitor (display) 20, an ink-jet printer 21, an ICC profile converting unit (preparing means) 17, and a spectrometer (measuring means) 16.

In this print system, the DTP unit 11 creates image data 15 concerning a pattern (page image) to be printed. The image data 15 created by the DTP unit 11 is loaded in the form of a bitmap (binary image data) in the RIP unit 12, and then input into the CTP unit 51, which directly makes a printing plate 14 from the input image data without a printing process using a film. The printing plate 14 is mounted on a plate cylinder of the printing press 52 and a printing operation is performed so that an image corresponding to the image data 15 is printed on a sheet so that a print sheet is generated.

Confirmation of a color tone on the print sheet requires a comparison standard color tone used for color correction. In this print system, a galley proof 15*d* generated by the ink-jet printer 21 serves as a comparison standard color tone for color correction that is to be carried out on an actual print result 15*b* and additionally, a corrective image 15*c* that is to be displayed on the monitor 20 can be formed as a comparison standard color tone, as shown in FIG. 7. Creation of such a proof sheet 15*d* and a corrective image 15*c* requires an ink-jet ICC profile 18*d* and a monitor ICC profile 18*c*, respectively, which further requires an ICC profile 18*a* for the printing press 52.

In the print system according to this embodiment, as shown in FIG. 6, the CTP unit 51 generates a printing plate 14 based on image data 15 created on the DTP unit 11 first of all, and printing is carried out with the printing plate 14 being mounted on the printing press 52, so that a color chart (a test sheet) 15*a* for an ICC profile preparation is obtained. Colors printed on the color chart 15*a* are measured by the spectrometer 16, and an ICC profile 18*a* is prepared by the ICC profile converting unit 17 on the basis of the measurement data obtained by the measurement.

The prepared ICC profile 18*a* is stored in a memory 62*a* and is used as a CMS database 62. Such an ICC profile 18*a* is generated for all possible combinations of a printing press and print materials (web, ink, dampening solution, blanket and the like) that the printing press can use, and is stored.

In particular, since each print site utilizes many print presses that may or may not be different in type, the CMS database 62 retains ICC profiles 18*a*, one for each of the print presses. The color management system 1 definitely recognizes the type of a printing press that is to be used for printing each page with reference to the print data recording unit 61, and performs, using the CMS database 62, color correction for color reproducibility on multilevel image data representing each page in accordance with types of printing materials to be used for the printing.

Figure 5:
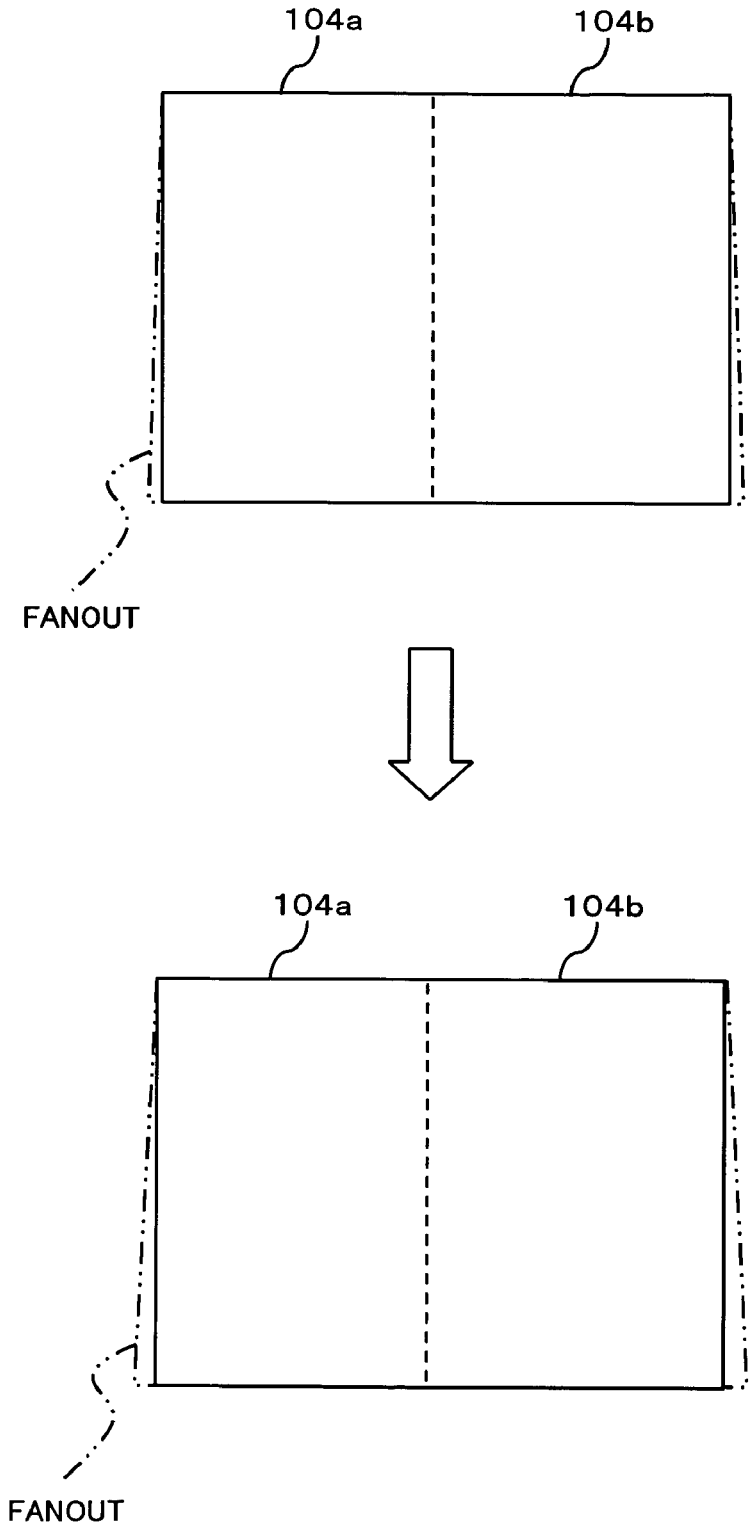
FIG. 5 is a diagram schematically illustrating a page which is to be subjected to fanout correction.

As shown in FIG. 5, in order to deal with the characteristic that web becomes wider when proceeding to a lower reach because of an effect of the dampening solution or the like, a fanout correction unit corrects binary image data created as a consequence of a process performed in the RIP unit 12 such that the lower reach of the web becomes gradually wider in accordance with an estimated amount of fanout. The correction may make the lower portion of a single printing plate gradually wider and in particular, make the lower reach of the printing roll 102 become gradually wider.

Each printing plate may be made by the above CTP unit but alternatively may be made by a CTF unit. Since a CTF unit creates a film on contrary to a CTP unit that creates a printing plate, a printing plate is made by using the created film and is further mounted on a plate cylinder of a corresponding newspaper rotary press by a manual operation of an operator.

Further alternatively, with presence of an on-board plate making system 53, the binary image data on which fanout correction has been performed may be sent to the on-board plate making system 53 and a series of printing processes from making a printing plate to printing the image on web may be automatically accomplished without manpower. Also in this case, control in accordance with data from the print data recording unit 61 can surely make a printing plate ready for printing in a printing press that is to print each page.

Each printing press is equipped with an automatic registration unit 54 and a cutoff controller 55. The automatic registration unit 54 monitors (recognizes) a registration mark by means of a non-illustrated monitoring camera (a registration mark recognition unit), and on the basis of data obtained by the monitoring, conducts feedback control for registration adjustment. Also the cutoff controller 55 monitors (recognizes) a cutoff mark by means of a non-illustrated monitoring camera (a cutoff mark recognition unit), and on the basis of data obtained by the monitoring, carries out feedback control to adjust a cutoff position.

Positions of the monitoring cameras (the registration mark recognition unit, the cutoff mark recognition unit) are automatically adjusted in accordance with position data managed by the registration position setting section 2 and the cutoff position setting section 3, respectively. In other words, since a registration mark and a cutoff mark are not put on fixed positions, each monitoring camera position in the width direction of the web 101 is adjusted to a width-direction position of a corresponding mark so that the mark can be surely monitored (recognized).

Additionally, cutoff control detects each cutoff mark using a camera at a predetermined timing and adjusts a cutoff position. If a position of a cutoff mark is not fixed in the machine direction (the web-running direction, the top-to-bottom direction of a space), the camera cannot detect each cutoff mark at a predetermined timing. In such a case, the camera may be arranged so as to be able to move in the web-running direction (the top-to-bottom direction of a space), and on the basis of the cutoff mark putting position data managed by the cutoff position setting section 3, the camera position in the machine direction may be automatically adjusted.

Figure 8A:
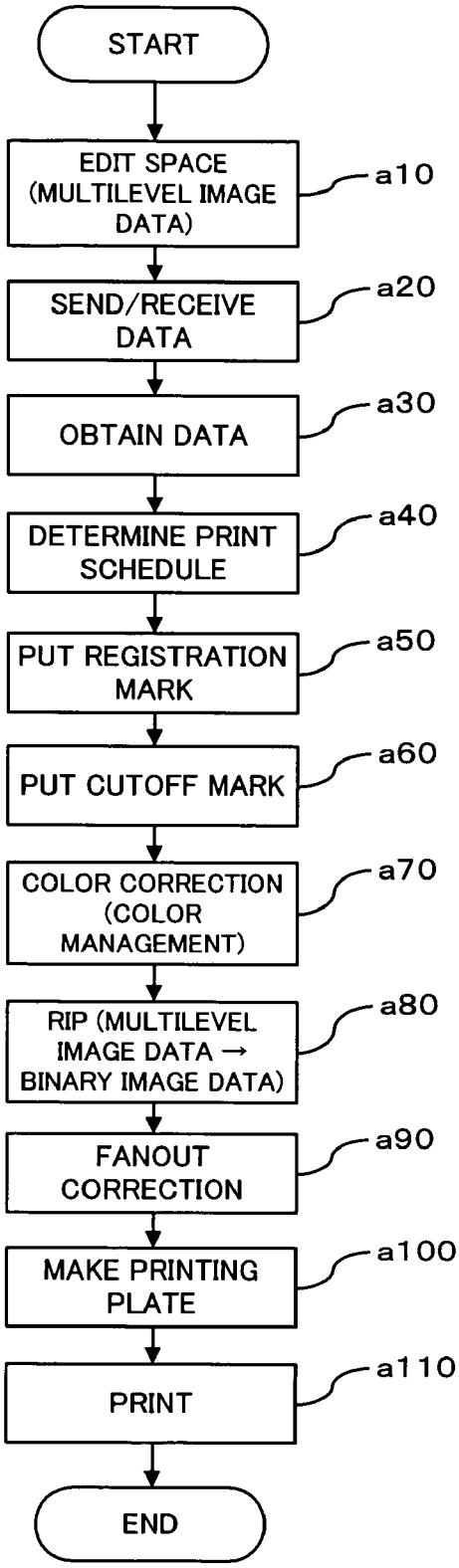
FIGS. 8(*a*) and 8(*b*) are flow diagrams showing successions of procedural steps of printing management for a newspaper print site according to the embodiment, and more specifically FIG. 8(*a*) concerns printing management and FIG. 8(*b*) concerns database prepared.
Figure 8B:
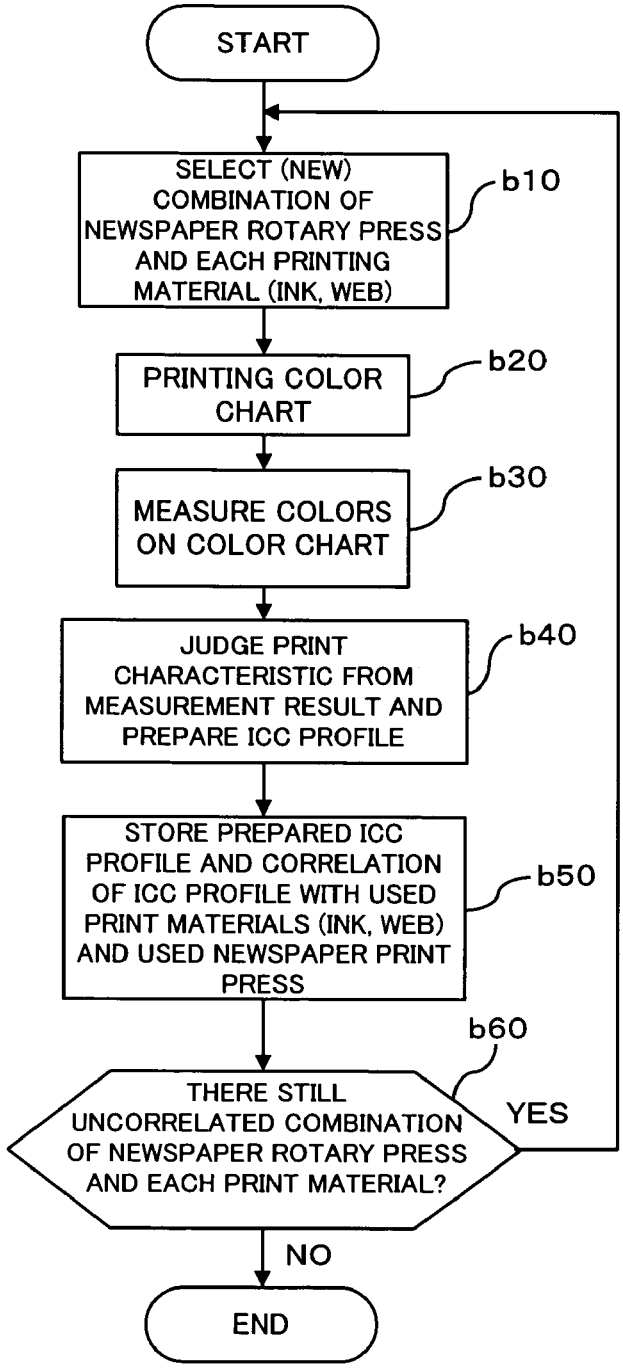
Figure 9:
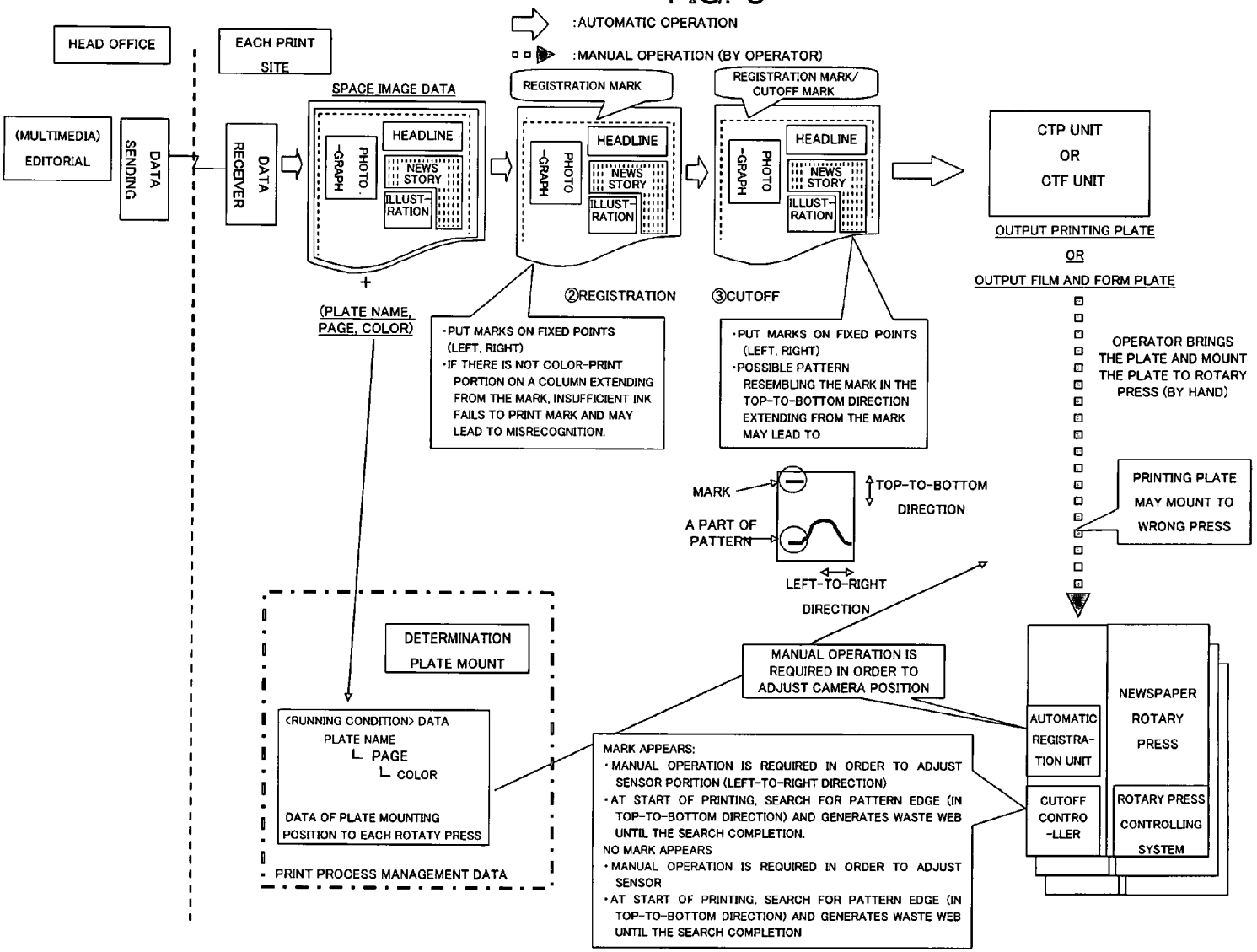
FIG. 9 is a block diagram schematically illustrating a conventional printing management method and a conventional printing management system.

The above-mentioned method and system for printing management according to an embodiment of the present invention manages printing carried out at a newspaper print site as shown by successions of procedural steps of the flow diagrams FIGS. 8(*a*), 8(*b*).

First of all, a database concerning an ICC profile is prepared by the procedural steps shown in FIG. 8(*b*).

Specifically, a combination of a newspaper rotary press type and printing material types (a web, an ink, a dampening solution, a blanket etc.) is selected (step b10) and a color chart is printed (step b20). Colors on the color chart are measured (step b30), and the printing characteristics of the combination are judged and an ICC profile is prepared (step b40). The prepared ICC profile is stored, along with the correlation of the file with the newspaper rotary press and the printing materials that have been used for the color chart (step b50). Judging as to the presence and absence of uncorrelated combination is made at step b60 and ICC profiles for all the possible combinations of a rotary press and printing materials are recorded and thereby the database is prepared.

In a printing process for a newspaper, as shown in the succession of procedural steps of FIG. 8(*a*), the editorial system 5 used in an editorial center located at the head office of a newspaper publisher prepares and edits newspaper pages in the form of multilevel image data (step a10), and sends/receives the data (step a20). Each newspaper print site obtains the data by receiving printing data concerning each page in the form of the multilevel image data representing page images (step a30) and firstly determines a print schedule (step a40). Specifically, on the basis of running condition data 61*a*, including "plate name", "page number", ink colors to be used for printing" and other information, received along with the multilevel image data, one of the printing presses (newspaper rotary presses) placed in the newspaper printing site is allocated to printing each of the newspaper pages. Further, printing materials such as a web, an ink, a dampening solution and a blanket used by each printing press are determined.

Subsequently, the registration mark putting section 2 puts a registration mark on page image data (step a50), and a cutoff mark putting section 3 puts a cutoff mark on the page image data (step a60). Further, the color management system (CMS) 1 carries out color management (color correction) on the page image data using the CMS database 62 (step a70). Then the RIP unit 12 carries out RIP on the multilevel image data to convert the data into binary image data (step a80) and the RIP is followed by fanout correction that the fanout correction section 4 performs on the converted binary image data (step a90).

On the basis of the binary image data obtained by the above succession of the procedural steps, a printing plate is made (step a100) and the page is printed over web (step a110).

Since, as mentioned above, the present method and system for printing management at a newspaper print site obtain multilevel image data, determine a printing schedule and manages future printing operations with the schedule being shared by printing presses placed at the site, it is possible to realize appropriate color management even at the newspaper print site, which has a number of printing presses may be of different types. As a result, newspaper pages in full color can be reproduced in a desired color tone with high accuracy, so that the newspaper obtains a higher commercial value.

In particular, if an editorial center of the newspaper head office prepares and edits a newspaper and sends newspaper page image data to each local print site, which prints newspaper pages, sending/receiving page image data in multilevel image data (or in binary image data convertible into multilevel image data) enables the CMS 1 to execute accurate color management on received page image data with ease.

Since the registration mark putting section 2 retrieves a position on which all the ink colors are to be surely printed from multilevel image data and puts a registration mark on the retrieved position, it is possible to surely recognize the registration mark and to thereby avoid color shift.

Further, a position of the camera (the registration mark recognition means) is automatically adjusted on the basis of position data of the registration mark. Consequently, accurate registration control can be carried out with ease.

Additionally, a cutoff mark putting section 3 retrieves a position from which a pattern resembling a cutoff mark is absent and places a cutoff mark on the retrieved position, so that the cutoff mark can be definitely recognized and an accurate cutoff can be conducted.

Also in this case, since the position of the cutoff mark recognition means is adjusted on the basis of position data of cutoff mark, it is possible to cut off web accurately.

Still further, fanout inhibition correction that the fanout correction unit 4 performs on binary image data having undergone RIP contributes to improvement in print quality.

In addition, use of an on-board plate making unit, which makes a printing plate ready for printing while being mounted on a newspaper rotary press on the basis of data recorded in a print data recording unit, as a plate making unit, further saves energy consumption and also reduces the chances of human error.

In this case, a preferable on-board plate making unit adopts an ink-jet method.

Various ink-jet plate making unit are known to the public. For example, FIG. 10 is a schematic diagram illustrating an ink-jet plate making unit disclosed in Japanese Patent Application Publication No. 2001-171071.

Figure 10:
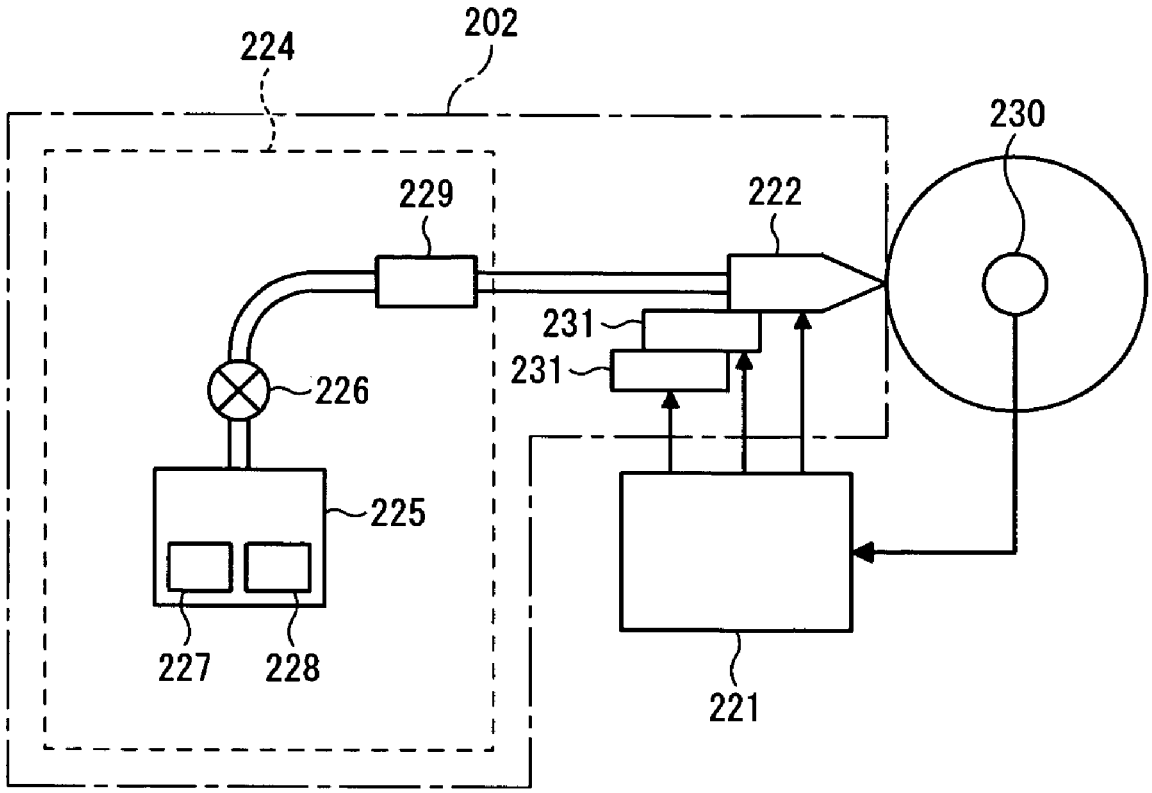
FIG. 10 is a block diagram schematically illustrating an example of a print unit used in the printing management method for a newspaper print site according to the embodiment.

As shown in FIG. 10, an ink-jet recording unit 202, serving as an image forming unit, includes an ink supplying unit 224 with an ink-jet head 222. The ink supplying unit 224 further has an ink tank 225, an ink supplier 226, and an ink consistency controller 229 in addition to the ink-jet head 222. Inside the ink tank 225, there are placed means 227 for stirring the ink in order to avoid precipitation and condensation of the ink solid and means 228 for controlling the temperature of the ink in order to ensure stable formation of a high-quality image that is constant in dot diameter.

The ink may circulate inside the ink-jet head 222 and in this case, the ink supplying unit also has a circulating and collecting function. The ink stirring means 227 includes one or more of moving vanes, a supersonic oscillator and a circulating pump. The ink temperature controlling means uses any method known to the public, the method arranging a heat generation element such as a heater or a Peltier device in the ink tank along with stirring means for keeping the temperature of the ink in the ink tank uniform and for controlling the temperature of the ink by means of a temperature sensor such as a thermostat.

The stirring means for keeping the temperature of the ink in the ink tank uniform may be shared with the ink stirring means 227 for avoiding precipitation and condensation of the ink solid.

For image formation of higher resolution, the ink supplying unit 224 of the illustrated example further includes ink consistency controlling means 229, which control the ink consistency by physical property measurement such as optical detection, conductivity measurement or viscosity measurement, or management concerning the number of printed sheets. Management by physical property measurement places one or more of an optical detector, a conductivity measure and a viscosity measure in the ink tank 225 or in the flow path of the ink, and controls the ink consistency based on output signals from these devices. Alternatively, management by the print sheet number controls a liquid supply to the ink tank 225 from a non-illustrated supplementary concentrated ink tank or a diluent ink carrier tank (i.e., an ink amount that is to be output from the ink-jet head 222) on the basis of the number of made printing plates and a frequency of making a printing plate.

The ink-jet recording unit 202 further includes head detaching unit 231 for moving a head, a head sub-scanning means 232 and an encoder 230 mounted on the plate cylinder. An image data arithmetic operator 221 intakes timing pulses from an encoder 330 on the basis of input binary image data and causes the head detaching unit 231 and/or the head sub-scanning means 232 to move the head in accordance with the timing pulses.

It is thereby possible to enhance the accuracy of a position in the sub-scanning direction (i.e., the page width direction). Additionally, when an ink-jet recording apparatus forms an image on the printing plate, the accuracy of a position in the sub-scanning direction concerning movement of the plate cylinder can be enhanced by high-accuracy driving means different from driving means used for normal printing operations. The driving is preferably carried out on the plate cylinder physically detached from the blanket cylinder, the impression cylinder and other units, i.e., only the plate cylinder is driven. More specifically, in order to drive only the plate cylinder, an output from a high-accuracy motor is decelerated by a high-accuracy gear or a steel belt. An image high in resolution can be formed by one or more of the above methods.

The ink-jet on-board plate making apparatus explained here is only an example, but an ink-jet method should by no means be limited to this. An on-board plate making apparatus adopts an ink-jet method and the ink-jet head outputs ink onto a hydrophilic surface of a printing plate in accordance with the binary image data to form a hydrophilic image area, so that the substantial registration gap can be eliminated. It is therefore possible to appropriately manage printing that is to be performed in the newspaper print site. Especially, since an ink-jet method outputs ink onto the hydrophilic surface of a printing plate in accordance with binary image data to form a hydrophilic image area and make the printing plate ready for printing, the printing plate can be made ready for printing by a simple procedure which can eliminate a development process (i.e., so-called processes). As a result, speedy printing management can be realized for a newspaper print site.

Further, the present invention should by no means be limited to this foregoing embodiment, and various changes or modifications may be suggested without departing from the gist of the invention.

For example, prior to the step of color correction, the succession of the procedural steps may further include a step of assigning a particular pattern that resembles a cutoff mark and that is not confused with another pattern as a substitutive cutoff mark. The particular pattern assigned as the substitutive cutoff mark in the step of assigning is recognized in order to adjust the cutoff position by feedback control in the step of cutting the web. In this case, the system preferably includes an additional cutoff mark assigning section for detecting a particular pattern that resembles a cutoff mark and that is not confused with another pattern and for automatically assigning the particular mark as the substitutive cutoff mark.

What is claimed is:

1. A method for printing management carried out in a newspaper print site in which a number of rotary presses of two or more types for newspaper are provided, said method obtaining image data representing an image of each page that has been edited in the form of multilevel image data along with associated data concerning the page, making a printing plate for the page based on said image data and causing one of the rotary presses to print the image of the page using the printing plate, and comprising the steps of:

(a) obtaining the multilevel image data and the associated data, and recording the multilevel image data and associated data as print data in a memory;

(b) selecting, on the basis of the multilevel image data and the associated data obtained in said step (a) of obtaining, at least one of the rotary presses that is to print the image of the page and a print material that is to be used for print of the image, and retaining schedule data including the one rotary press selected and the print material selected as the print data in the memory;

(c) performing color correction for color reproducibility on the multilevel image data obtained in said step (a) of obtaining in accordance with a type of the one rotary press and a type of the print material selected in said step (b) of selecting, based on color management data that has previously been prepared in consideration of a combination of the type of the one rotary press and the type of the print material selected in said step (b) of selecting;

(d) performing RIP (Raster-Image Processing) on the multilevel image data, on which the color correction has been performed in said step (c) of performing color correction, so that the multilevel image data is converted into binary image data;

(e) forming the image of the page on a plate, using the binary image data obtained in said step (d) of performing RIP, so that the printing plate is made ready for printing; and at the one rotary press selected in said step (b) of selecting (f) printing the image of the page on a web, using the printing plate made ready for printing in said step (e) of forming and the print material selected in said step (b) of selecting.

2. A method for printing management according to claim 1, further comprising the step of preparing the color management data being performed prior to said step (c) of performing color correction and comprising the sub-steps of:

(i) measuring printing colors on color charts printed one by each of possible combinations of one of the rotary presses and a print material;

(ii) preparing profile data representing a print characteristic of said each possible combination on the basis of a result of said step (i) of measuring; and (iii) retaining the profile data and correlation of the profile data with a type of the one rotary press and a type of the print material of said each possible combination for preparing the color management data.

3. A method for printing management according to claim 1, further comprising the steps of:

prior to said step (c) of performing color correction, retrieving a position on which all the printing colors are to be surely printed in the image of the page from the multilevel image data, and putting a registration mark in accordance with the position retrieved in said step of retrieving, wherein, in said step (f) of printing, registration is carried out by feedback control, recognizing the registration mark put in said step of putting.

4. A method for printing management according to claim 3, wherein registration mark recognition means for recognizing the registration mark is adjustably disposed on the one rotary press, and a position of the registration mark recognition means is automatically adjusted in accordance with position data of the registration mark.

5. A method for printing management according to claim 1, further comprising the steps of:

prior to said step (c) of performing color correction, retrieving a position on which a pattern resembling a cutoff mark does not appear from the multilevel image data, and putting the cutoff mark in accordance with the position retrieved in said step of retrieving; and after said step (f) of printing, cutting the web on which the image has been printed in said step (f) of printing into sheets each having a predetermined length, wherein, in said step of cutting, positions at which the web is cut into the sheets are adjusted by feedback control, recognizing the cutoff mark put in said step of putting.

6. A method for printing management according to claim 5, wherein cutoff mark recognition means for recognizing the cutoff mark put in said step of putting is adjustably disposed on each of the rotary presses, and a position of said cutoff mark recognition means is automatically adjusted in accordance with position data of the cutoff mark.

7. A method for printing management according to claim 1, further comprising the steps of:

prior to said step (c) of performing color correction, assigning a particular pattern that resembles a cutoff mark and that is not confused with another pattern as a substitutive cutoff mark; and after said step (f) of printing, cutting the web on which the image has been printed in said step (f) of printing into sheets each having a predetermined length, wherein, in said step of cutting, positions at which the web is cut into the sheets are adjusted by feedback control, recognizing the substitutive cutoff mark assigned in said step of assigning.

8. A method for printing management according to claim 7, wherein cutoff mark recognition means for recognizing the substitutive cutoff mark assigned in said step of assigning is adjustably disposed on each of the rotary presses, and a position of said cutoff mark recognition means is automatically adjusted in accordance with position data of the substitutive cutoff mark.

9. A method for printing management according to claim 1, further comprising the step of performing fanout inhibition correction on the binary image data obtained in said step (d) of performing RIP.

10. A method for printing management according to claim 1, further comprising the steps of:

at an editorial site different in location from the printing site, preparing the multilevel image data representing the image of the page;

sending the multilevel image data prepared in-said step preparing and the associated data concerning the multilevel image data to the newspaper print site from the editorial site through communication means.

11. A system for printing management carried out in a newspaper print site in which a number of rotary presses of two or more types for newspaper are provided comprising:

a database for retaining color management data that has previously been prepared in consideration of possible combinations of a type of each of the rotary presses and a type of each print material each of the combinations being used for printing;

a print data storing apparatus for storing image data representing an image of a page that has been edited in the form of multilevel image data, associated data concerning the page, a type of at least one of the rotary presses that is to print the image of the page and a type of a print material that is to be used for printing the image along with a correlation among the multilevel image data, the associated data, the type of the one rotary press and the type of the print material;

a color management apparatus for obtaining a portion of the color management data from said database which portion concerns the type of the one rotary press and the type of the print material that are to be used to print the image of the page and performing correction for color reproducibility on the multilevel image data, depending on the type of the one rotary press and the type of the print material, on the basis of the portion of the color management data;

a RIP (Raster-Image Processing) unit for performing RIP on the multilevel image data, on which the correction has been performed by said color management apparatus, into binary image data;

a printing plate making unit for recording the image of the page, using the binary image data, into which the multilevel image data has been converted by said RIP unit, on a printing plate, so that the printing plate is made ready for printing;

the one rotary press for printing the image of the page on a web in a state that the printing plate, which is made ready for printing by said printing plate making unit, is mounted on said one rotary press using the print material on the basis of the correlation stored in said print data storing apparatus.

12. A system for printing management according to claim 11, further comprising:

an imaging unit for measuring colors printed on color charts one printed by each of the possible combinations; and a profile data preparing unit for preparing profile data representing a print characteristic for each said possible combination on the basis of the measuring of the colors by said imaging unit, said database being prepared by correlating the profile data and each said possible combination.

13. A system for printing management according to claim 11, further comprising a registration mark putting section for retrieving a position on which all the printing colors are to be surely printed in the image of the page from the multilevel image data and putting a registration mark in accordance with the position retrieved, said one rotary press carrying out registration by feedback control, recognizing the registration mark, which has been put by said registration mark putting section.

14. A system for printing management according to claim 13, further comprising a registration mark recognition section, adjustably disposed, for recognizing the registration mark, a position of said registration mark recognition section being automatically adjusted in accordance with position data of the registration mark, which has been put by said registration mark putting section.

15. A system for printing management according to claim 11, further comprising:

a cutoff unit, mounted on said one rotary press, for cutting the web on which the image has been printed by said one rotary press into sheets each having a predetermined length; and a cutoff mark putting section for retrieving a position on which a pattern resembling a cutoff mark does not appear from the multilevel image data and putting the cutoff mark in accordance with the position retrieved, said cutoff unit adjusting a position at which the web is cut into the sheet by feedback control, recognizing the cutoff mark, which has been put by said cutoff mark putting section.

16. A system for printing management according to claim 15, further comprising a cutoff mark recognizing section, adjustably disposed, for recognizing the cutoff mark, which has been put by said cutoff mark putting section a position of said cutoff mark recognizing section being automatically adjusted in accordance with position data of the cutoff mark.

17. A system for printing management according to claim 11, further comprising:

a cutoff unit, mounted on said one rotary press, for cutting the web on which the image has been printed by said one rotary press into sheets each having a predetermined length; and a cutoff mark assigning section for assigning a particular pattern that resembles a cutoff mark and that is not confused with another pattern as a substitutive cutoff mark; and said cutoff unit adjusting positions at which the web is cut into the sheets by feedback control, recognizing the substitutive cutoff mark, which has been assigned by said cutoff mark assigning section.

18. A system for printing management according to claim 17, further comprising a cutoff mark recognizing section, adjustably disposed, for recognizing the substitutive cutoff mark, which has been assigned by said cutoff mark assigning section, a position of said cutoff mark recognizing section being automatically adjusted in accordance with position data of the substitutive cutoff mark.

19. A system for printing management according to claim 11, further comprising a fanout correction unit for performing fanout inhibition correction on the binary image data obtained by said RIP unit.

20. A system for printing management according to claim 11, further comprising:

an editorial system, disposed at an editorial site different in location from the newspaper print site, for preparing the multilevel image data representing the image of the page; and a communication unit for sending the multilevel image data prepared in said editorial site and the associated data concerning the multilevel image data prepared to the newspaper print site from the editorial site.

21. A system for printing management according to claim 11, wherein said printing plate making unit is an on-board printing plate making unit for making the printing plate on the basis of the print data stored in said print data storing apparatus with the printing plate being mounted on said one printing press.

22. A system for printing management according to claim 21, wherein said on-board printing plate making unit applies ink on a hydrophilic surface of the printing plate in accordance with the binary image data from an ink-jet head in order to form an oleophilic image area representing the image of the page on the surface, so that the printing plate is made ready for printing.

* * * * *